United States Patent [19]

Greene et al.

[11] Patent Number: 4,936,617

[45] Date of Patent: Jun. 26, 1990

[54] APPARATUS FOR DETACHABLY COUPLING A LOAD TO A CRANE

[75] Inventors: Graydon L. Greene, Circle Pines; Daniel R. Speelman, Minneapolis, both of Minn.

[73] Assignee: John A. Dalsin & Son, Inc., Minneapolis, Minn.

[21] Appl. No.: 295,848

[22] Filed: Jan. 11, 1989

[51] Int. Cl.[5] ..... B66C 1/14

[52] U.S. Cl. ..... 294/82.3; 294/75; 294/82.31

[58] Field of Search ..... 294/68.2, 68.21, 66.1, 294/74–77, 82.24–82.77, 82.3, 82.31, 82.33–82.36, 97

[56] References Cited

U.S. PATENT DOCUMENTS

| | | | |
|---|---|---|---|
| 664,057 | 12/1900 | Olson | 294/75 |
| 845,693 | 2/1907 | Coats et al. | 294/75 X |
| 898,329 | 9/1908 | Coulter et al. | 294/82.31 |
| 1,239,700 | 9/1917 | Konczak | 294/75 |
| 1,773,805 | 8/1930 | Bouchard | 294/77 |
| 2,986,421 | 5/1961 | Grove | 294/82.3 |
| 3,383,721 | 5/1968 | Adams | 294/76 X |
| 4,077,660 | 3/1978 | Phillips | 294/75 |
| 4,185,864 | 1/1980 | Phillips et al. | 294/82.3 |

FOREIGN PATENT DOCUMENTS

| | | | |
|---|---|---|---|
| 235560 | 1/1969 | U.S.S.R. | 294/82.31 |
| 1081110 | 3/1984 | U.S.S.R. | 294/82.34 |

*Primary Examiner*—Johnny D. Cherry
*Attorney, Agent, or Firm*—Dorsey & Whitney

[57] ABSTRACT

A cargo bag made from a generally flat piece of canvas or the like has a plurality of attachment loops along its peripheral edge. The bag is attached to the operating cable of a crane by a coupling device that releasably engages some of the cargo bag loops. One of the loops is unreleasably carried by a fixed hook. The remainder of the loops are retained by the fingers of a shiftable fork assembly. The fork assembly is pivotably between a bag retaining position and a bag release position. A remotely actuated, hydraulic piston and cylinder assembly provides for selective shifting of the fork assembly between the cargo bag retaining and release positions.

17 Claims, 3 Drawing Sheets

APPARATUS FOR DETACHABLY COUPLING A LOAD TO A CRANE

TECHNICAL FIELD

The subject invention pertains to material handling devices. In particular, it applies to an apparatus for detachably coupling a load bearing cargo bag to the working cable of a crane or the like.

BACKGROUND ART

The use of cranes to remove debris from elevated work sites is commonplace. One such use is in the roofing industry. The old materials making up a worn roof must be torn up and removed to ground level for disposal. It is common in such instances to fill a cargo bag with the old roofing debris, and lift the bag from the roof to the ground with a crane. The cargo bags used to carry the debris typically comprise a generally flat canvas material having a plurality of corner loops along its peripheral edge. When attached to an elevated hook by its corner loops, the canvas takes the shape of a cargo retaining bag.

Refuse-carrying cargo bags are typically coupled to the operating cable of a crane by a hook. A worker must be stationed on the roof to attach the corner loops of the cargo bag to the hook. A second worker is required to operate the crane. In conventional operations, a third worker must be stationed at ground level to disengage the cargo bag loops from the crane hook. Stationing a worker at ground level to release the cargo bag presents a safety hazard to the ground level worker since debris can fall from the cargo bag onto the worker as the bag is lowered to the ground. Moreover, stationing a worker on the ground at the drop off point is an inefficient use of labor, since the worker must wait idle during often lengthy intervals between loads.

SUMMARY OF THE INVENTION

The problems outlined above are in large measure solved by the apparatus for attaching a load to the working cable of a crane in accordance with the present invention. The apparatus hereof provides for the safe, and remotely actuated release of a load from a cargo bag attached to the operating cable of a crane.

The crane coupling device hereof includes a hydraulically actuated, releasable fork assembly that can be shifted between a cargo bag retaining position and a release position. The fork assembly comprises a pair of loop engaging fingers and a spreader plate extending between the fingers. The spreader plate is designed to prevent mutual entanglement of the plurality of cargo bag loops carried by the fork assembly. A remotely actuated hydraulic piston and cylinder assembly selectively shifts the fork assembly between the retaining position and the release position. A second, fixed retainer hook assembly is provided to provide a nonreleasable attachment of a single cargo bag loop to the cable.

DETAILED DESCRIPTION OF THE DRAWINGS

Figures 1, 2:
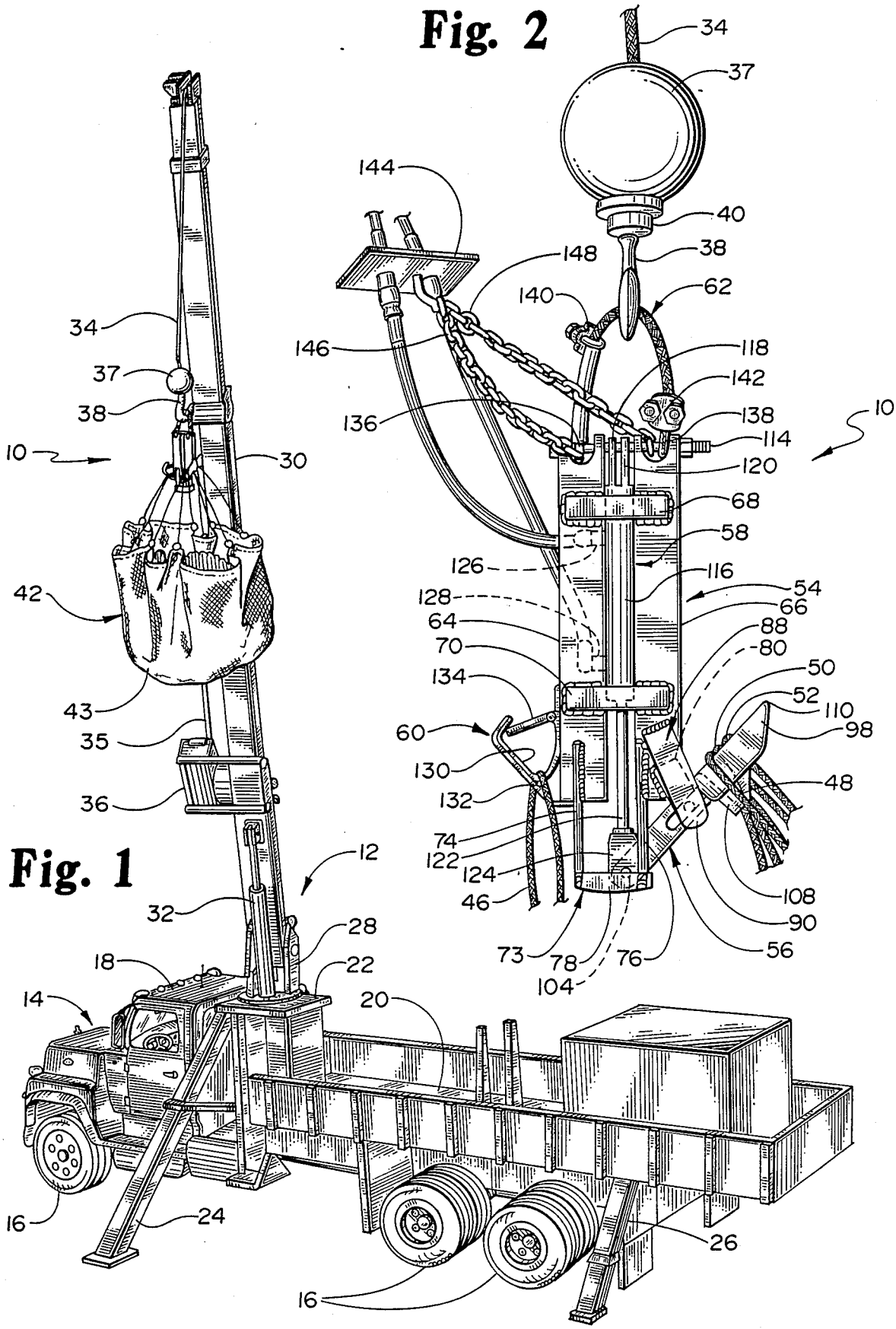
FIG. 1 is a perspective view of a truck mounted crane assembly depicting a load carrying cargo bag attached to the operating cable of the crane by a coupling device in accordance with the present invention.
FIG. 2 is a side elevational view of a crane coupling device in accordance with the present invention.

Referring to the drawings, a coupling device 10 is depicted in conjunction with a crane 12 mounted on a truck 14. The truck 14 broadly includes ground engaging wheels 16, an operator's cab 18, flat bed 20, mount 22, and front and rear, retractable support struts 24, 26. The crane 12 is supported on the mount 22 by rotatable turret 28.

Crane 22 includes telescoping boom 30, elevational ram 32, and operating cable 34. Hydraulic lines 35 are windably stored on hydraulic line reel 36. The cable 34 terminates, at its operating end, at cable fist 37. A hook 38 is rotatably attached to the cable fist 37 by swivel assembly 40.

Cargo bag 42 is carried by the coupling device 10. The cargo bag 42 comprises a generally flat piece of canvas 43 having a plurality of bag loops 46, 48, 50, 52 attached to its peripheral edge.

Coupling device 10 broadly includes frame 54, shiftable fork assembly 56, fork assembly actuating piston and cylinder assembly 58, retainer hook 60, and bail 62.

Figure 4:
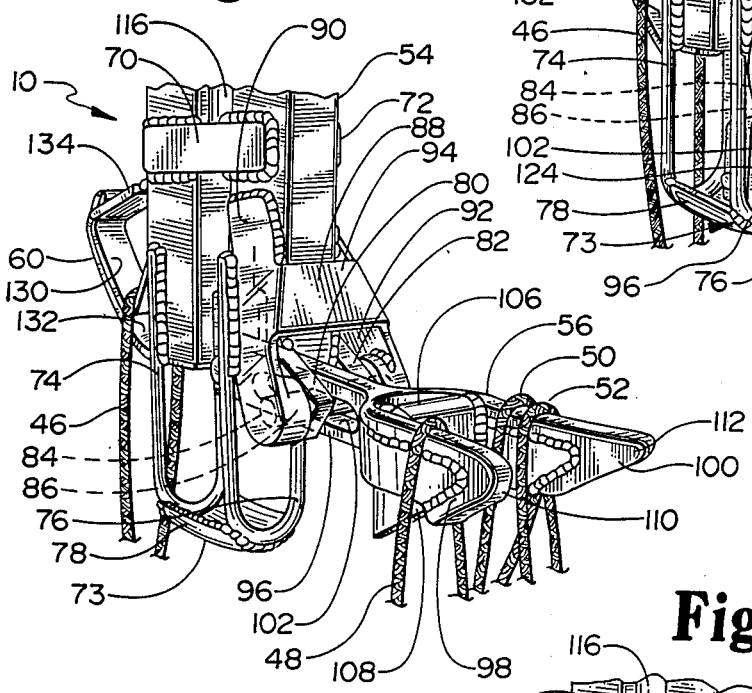
FIG. 4 is similar to FIG. 3 but with the crane coupling device fork assembly rotated downwardly towards the release position.
Figure 5:
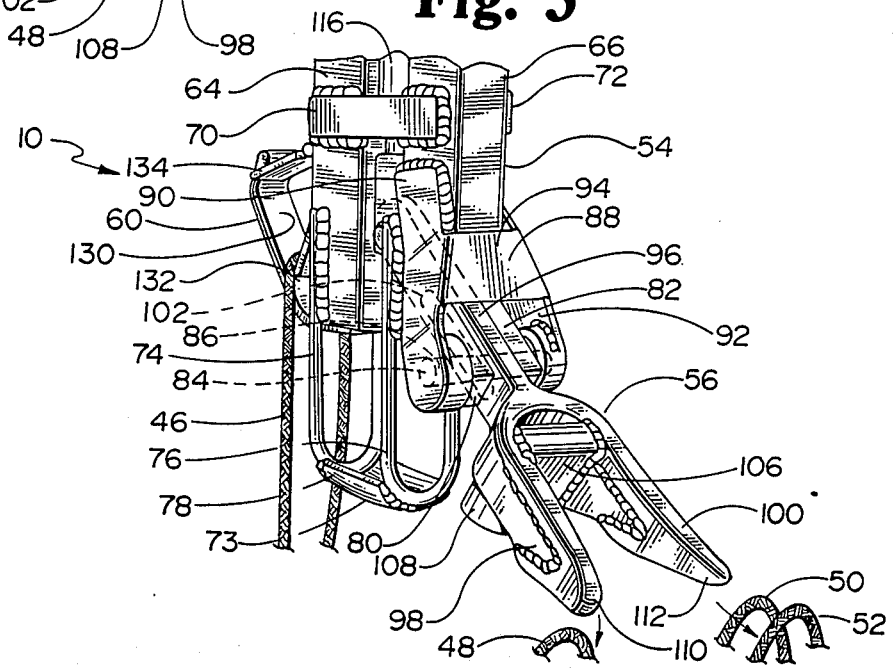
FIG. 5 is similar to FIG. 4 but with the fork assembly shown fully rotated into the cargo bag release position.

Frame 54 comprises front and rear, spaced apart, square mechanical tubing sections 64, 66. Bridge members 68, 70, comprising flat bar stock, extend between and are welded to the front and back sections 64, 66 of the frame 54. Referring to FIGS. 3–5, it will be understood that the frame 54 includes a lower bridge member 72, and an upper bridge member (not shown) on the side of frame 54 opposite to the side shown in FIG. 2.

Shroud 73 extends below the lowermost portion of the square mechanical tubing sections 64, 66. As best seen in FIGS. 3–5, shroud 73 includes fore and aft U-shaped brackets 74, 76 fixedly welded to the fore and aft frame sections 64, 66, respectively, and lowermost plate 78 extending between and welded to the fore and aft brackets 74, 76.

A pair of spaced apart fork assembly retaining brackets 80, 82 extend downwardly and outwardly from frame back section 66. Each bracket 80, 82 includes a cross pin receiving aperture 84. Cross pin 86 is received within the cross pin receiving apertures 84, and extends between the right and left fork assembly brackets 80, 82. Cross pin end cover 88 includes right and left cover arms 90, 92 interconnected by plate 94. The cross pin bracket cover arms 90, 92 are welded, and depend downwardly and outwardly from, the back section 66 of frame 54.

Shiftable fork assembly 56 includes stem 96 and loop engaging fingers 98, 100. The stem 96 includes elongated slot 102 along its approximate midportion, and aperture 104 proximal the butt of the stem. The fingers 98, 100 form a generally U-shaped operating end for the fork assembly 56. Spreader plate 106 extends between the fingers 98, 100 near the base of the U. As is best seen in FIG. 3, the spreader plate 106 extends outwardly beyond the bottom plane defined by the fingers 98, 100 of fork assembly 56, and is supported by spreader truss 108. The fingers 98, 100 include generally tapered tips 110, 112. The tips 110, 112 are flared outwardly with respect to each other.

Fork assembly actuating piston and cylinder assembly 58 is suspended between the front and back frame sections 64, 66 by supporting bolt 114. Bolt 114 extends between the top portions of the frame sections 64, 66. The piston and cylinder assembly 58 includes cylinder 116 connected to the supporting bolt 114 by end supports 118, 120, and downwardly depending piston ram 122. The piston ram 122 terminates in fork assembly retaining clevis 124. Hydraulic lines 35 are connected to the cylinder 116 at fittings 126, 128.

Retainer hook 60 comprises generally U-shaped hook element 130, support bracket 132, and spring biased retainer jaw 134. The hook element 130 is welded to the back side of front frame section 64. Bracket 132 extends from the hook element 130 to the base of the frame front section 64. Jaw 134 is pivotally coupled to the fork element 130, and is biased to the closed position indicated in the drawings.

Bail 62 comprises a wire rope. The, ends of the bail rope are formed into bolt retaining loops 136, 138 by clamps 140, 142. Bolt 114 is received by the bolt retaining loops 136, 138.

The hydraulic lines 35 are attached to fitting plate 144. Fitting plate 144 is connected to the frame 54 of coupling device 10 by strain relief chains 146, 148.

In operation, cargo bag 42 would normally be placed flat on the roof, or other area, from which debris or cargo is to be removed. The load of debris or other cargo is placed on the canvas 43 of the cargo bag 42. One of the cargo bag loops 46 would be attached to the retainer hook 60. Fork assembly 56 is shifted to the cargo bag retaining position depicted in FIGS. 2 and 3 by extending the piston ram 122 of the piston and cylinder assembly 58. Plate 78 of shroud 73 protects the clevis 124 and piston ram 122, when the piston and cylinder assembly 58 is in the extended position.

Figure 3:
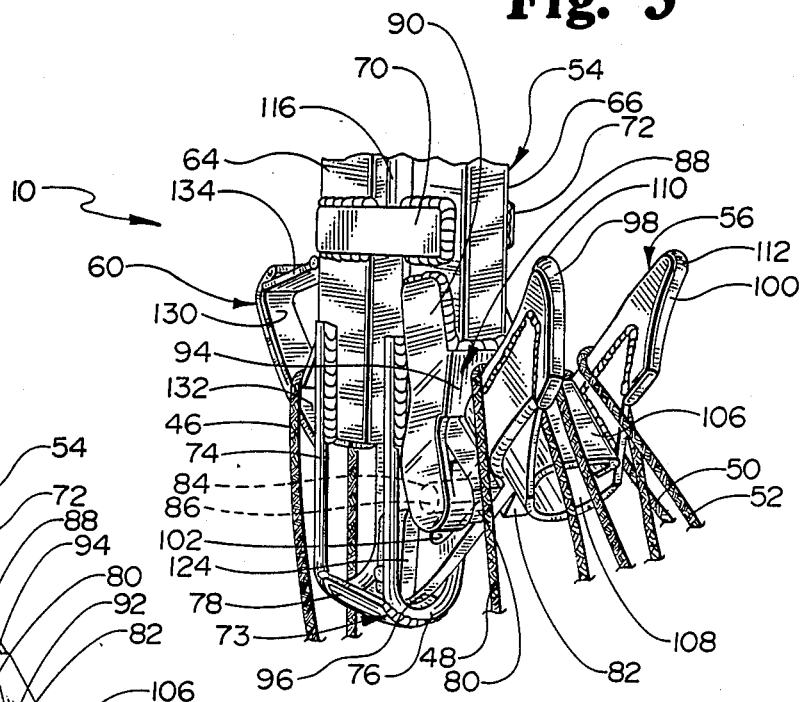
FIG. 3 is an enlarged, fragmentary, perspective view of the crane coupling device depicted in FIG. 2.

Once the fork assembly 56 is shifted to the cargo bag retaining position depicted in FIGS. 2 and 3 as described above, the remaining loops 48, 50, 52 are inserted over the fingers 98, 100 of the fork assembly 56. Referring to FIG. 3, it will be appreciated that the spreader plate 106 prevents the loops 48, 50, 52 from entangling at the intersection of the fingertips 110, 112. Moreover, the cross pin end coner 88 prevents the loops 48, 50, 52 from becoming entangled with the brackets 80, 82 and the cross pin 86.

With the cargo bag 42 securely engaged by the coupling device 10, as depicted in FIG. 3, the cargo bag 42, together with its load, can be lifted and shifted away from the work site through the normal operation of the crane 12.

FIGS. 3–5 depict the release sequence for depositing the load carried by the cargo bag 42 at a desired location. FIG. 3 shows the loops 48, 50, 52 positively retained by the fork assembly 56. In FIG. 4, the piston ram 122 of piston and cylinder assembly 58 is shown partially retracted, causing the fork assembly 56 to lower. FIG. 5 depicts the piston ram 122 of piston and cylinder assembly 58 fully retracted, causing the fork assembly 56 to be oriented in its release position. Cargo bag loops 48, 50, 52 fall from the fingers 98, 100 of fork assembly 56 under the weight of gravity. Referring to FIGS. 2–5, it will be appreciated that the elongated slot 102 in fork stem 96 allows the fork assembly 56 to shift along cross pin 86 as it is pivoted between the bag retaining position of FIG. 3 and the release position of FIG. 5.

Figure 6:
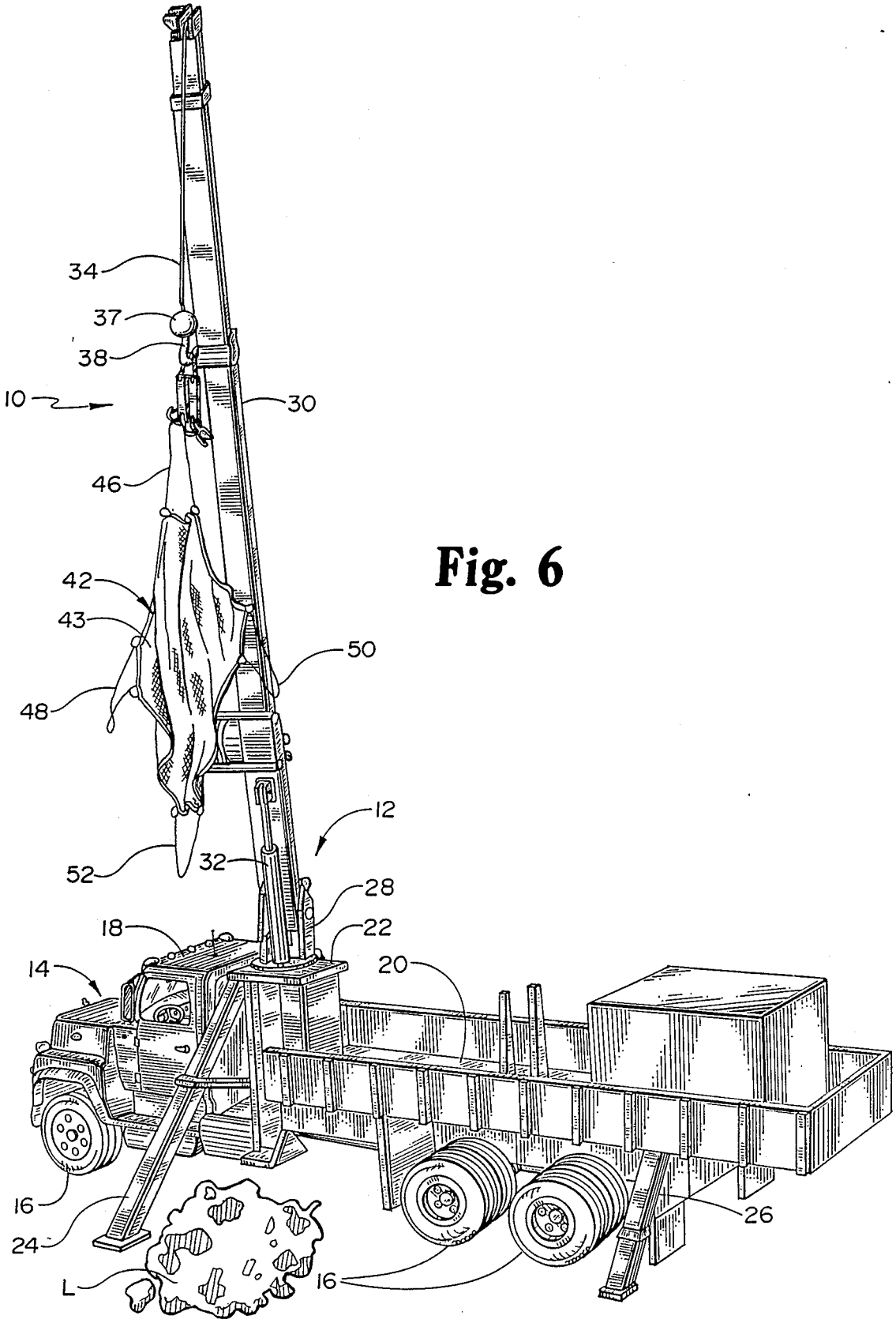
FIG. 6 is similar to FIG. 1, but with the load released from the cargo bag.

Referring to FIG. 6, it will be seen that the entire load L can be deposited at a desired location by rotating and positioning the crane 12 over the desired spot, and then shifting the fork assembly 56 of coupling devicc 10 to its release position. The shifting of the fork assembly 56 can be accomplished remotely, preferably, through hydraulic controls located in the crane operator's control area. As depicted in FIG. 6, the cargo bag cover bag loop 46 is retained by retainer hook 60, even after release of loops 48, 50, 52. The cargo bag 42 can accordingly be positioned by the crane 12 back on the roof or other work area, to be filled with the next load of cargo.

I claim:

1. An apparatus for detachably coupling a cargo bag or the like having a plurality of retaining loops along its peripheral edge to the operating cable of a crane, comprising:

a support frame having a top end and a lower end, and opposed front and rear faces;

means for operably coupling said top end of said support frame to said operating cable;

an elongated loop retaining member having an exposed end and an opposed, second end, and structure defining an elongated slot interposed between said exposed and second ends for slidable, pivotal mounting of said loop retaining member to said support frame, said loop retaining member being shiftable between a retaining position and a release position, and including means along said exposed end for receiving certain of said retaining loops in operable attachment to said apparatus when said loop retaining member is in said retaining position;

means operably coupled to said support frame for receiving and retaining at least one of said retaining loops in operable attachment with said apparatus when said loop retaining member is in said release position; and actuating means operably coupled to said loop retaining member.second end for selectively shifting said second end between lowered and raised positions whereby said loop retaining member is shifted along said elongated slot between said retaining and release positions.

2. The invention as claimed in claim 1, said loop retaining member comprising a fork assembly having a fork head at said retaining member exposed end and a stem, said slot being positioned within said stem.

3. The invention as claimed in claim 2, including a pivot pin carried by said support frame and received through said slot for slidable, pivotal mounting of said stem to said support frame.

4. The invention as claimed in claim 2, said fork head comprising a pair of spaced loop engaging finger elements and spreader means for maintaining said plurality of looops in generally spaced apart relationship when said loop retaining member is in said retaining position and said plurality of loops are received by said retaining member.

5. The invention as claimed in claim 4, said spreader means comprising a spreader plate carried between said finger elements.

6. The invention as claimed in claim 4, each finger element presenting a finger element tip, said finger element tips being flared outwardly away from each other.

7. The invention as claimed in claim 2, said actuating means comprising a piston and cylinder assembly carried by said support frame and operably coupled to said fork assembly stem, said piston and cylinder assembly being shiftable between extended and retracted positions for shifting said retaining member second end between said lowered and raised positions, said support frame including a lowermost shroud for shielding said piston and cylinder assembly when the piston and cylinder assembly is in its extended position.

8. The invention as claimed in claim 1, said means for receiving and retaining at least one of said retaining loops comprising a generally U-shaped hook element and a biased retainer jaw element.

9. An apparatus for detachably coupling a cargo bag or the like having a plurality of retaining loops along its peripheral edge to the operating cable of a crane, comprising:

a support frame;

means for operably coupling said support frame to said operating cable;

an elongated loop retaining member having an exposed end and an opposed, second end, said loop retaining member shiftable between loop retaining and loop releasing positions and including means along said exposed end for receiving certain of said retaining loops in operable attachment to said apparatus when said loop retaining member is in said retaining position;

means operably coupled to said loop retaining member second end for selectively shifting said second end along a generally straight line path of travel between lowered and raised positions whereby said loop retaining member is shifted between said retaining and release positions; and means operably coupling said elongated loop retaining member to said support frame for the slidable, pivotal engagement of said loop retaining member by said support frame whereby said loop retaining member is pivotable between said retaining and release positions as said second end is shifted along said generally straight line path of travel.

10. The invention as claimed in claim 9, said loop retaining member including structure defining an elongated slot interposed between said exposed and second ends, said means operably coupling said elongated loop retaining member to said support frame comprising a pivot pin carried by said support frame and received through said slot.

11. The invention as claimed in claim 10, said loop retaining member comprising a fork assembly having a fork head at said retaining member exposed end and a stem, said slot being positioned within said stem.

12. The invention as claimed in claim 11, said fork head comprising a pair of spaced loop engaging finger elements and spreader means for maintaining said plurality of loops in generally spaced apart relationship when said loop retaining member is in said retaining position and said plurality of loops are received by said retaining member.

13. The invention as claimed in claim 12, said spreader means comprising a spreader plate carried between said finger elements.

14. The invention as claimed in claim 12, each finger element presenting a finger element tip, said finger element tips being flared outwardly away from each other.

15. The invention as claimed in claim 11, said actuating means comprising a piston and cylinder assembly carried by said support frame and operably coupled to said fork assembly stem, said piston and cylinder assembly being shiftable between extended and retracted positions for shifting said retaining member second end between said lowered and raised positions, said support frame including a lowermost shroud for shielding said piston and cylinder assembly when the piston and cylinder assembly is in its extended position.

16. The invention as claimed in claim 9, including means operably coupled to said support frame for receiving and retaining at least one of said retaining loops in operable attachment with said apparatus when said loop retaining member is in said release position.

17. The invention as claimed in claim 16, said means for receiving and retaining at least one of said retaining loops comprising a generally U-shaped hook element and a biased retainer jaw element.

* * * * *